US008684466B2

(12) United States Patent
Blair

(10) Patent No.: US 8,684,466 B2
(45) Date of Patent: Apr. 1, 2014

(54) MODULAR KNOCK-DOWN UPHOLSTERED FURNITURE

(76) Inventor: Michael Blair, Cincinnati, OH (US)

( * ) Notice: Subject to any disclaimer, the term of this patent is extended or adjusted under 35 U.S.C. 154(b) by 318 days.

(21) Appl. No.: 13/011,438

(22) Filed: Jan. 21, 2011

(65) Prior Publication Data

US 2012/0187737 A1 Jul. 26, 2012

(51) Int. Cl.
*A47C 7/00* (2006.01)

(52) U.S. Cl.
USPC ..... 297/440.13; 297/440.1; 297/440.14

(58) Field of Classification Search
USPC ..... 297/440.13, 440.14, 440.1, 440.15; 403/231
See application file for complete search history.

(56) References Cited

U.S. PATENT DOCUMENTS 2,129,555 A 9/1938 Anton
2,147,437 A 2/1939 Gross
2,816,342 A 12/1957 Hyre
3,102,501 A 9/1963 Sutherlan
3,123,395 A 3/1964 Glass
3,929,374 A 12/1975 Hogan et al.
4,140,065 A * 2/1979 Chacon ..... 108/156
4,632,459 A * 12/1986 Herschlag ..... 297/440.1
4,697,847 A * 10/1987 Herschlag ..... 297/440.1
5,372,405 A * 12/1994 Cash et al. ..... 297/383
5,733,002 A * 3/1998 Riley et al. ..... 297/224
6,267,446 B1 * 7/2001 Wieland et al. ..... 297/440.13
6,568,058 B1 * 5/2003 Wieland et al. ..... 29/91.1
6,619,749 B2 9/2003 Willy
6,688,699 B1 * 2/2004 Bowie ..... 297/440.14
6,981,747 B2 * 1/2006 Wieland et al. ..... 297/440.11
7,014,267 B1 3/2006 Nagar
7,044,557 B2 * 5/2006 Wieland ..... 297/440.1
7,318,764 B2 1/2008 Elias
7,413,254 B2 8/2008 Petre, Jr.
7,523,989 B2 * 4/2009 Wieland et al. ..... 297/440.13
7,533,940 B1 5/2009 Zook
7,568,767 B2 8/2009 Richardson
7,686,173 B2 3/2010 Robinson et al.
7,744,161 B2 * 6/2010 Berg et al. ..... 297/440.13
7,832,571 B2 11/2010 Felsenthal
7,984,680 B1 7/2011 Tsai et al.
8,001,911 B2 8/2011 Yankello et al.
8,079,315 B2 12/2011 Berent et al.
8,141,723 B2 3/2012 Whalen et al.
8,167,377 B2 * 5/2012 Kovach ..... 297/440.13
8,181,581 B2 5/2012 Meiners
8,220,398 B1 7/2012 Brandenberg
8,220,399 B2 7/2012 Berent et al.
8,231,301 B1 7/2012 Joyce
8,251,441 B2 8/2012 Alink
8,316,781 B1 11/2012 Majors
8,356,720 B2 1/2013 Mathews (Continued)

OTHER PUBLICATIONS

Lovesac History (2010) at http://www.lovesac.com/history (last visited May 6, 2011), 3 pages.

(Continued)

*Primary Examiner* — David R Dunn
*Assistant Examiner* — Alexander Harrison
(74) *Attorney, Agent, or Firm* — Wood, Herron & Evans, LLP

(57) ABSTRACT

A knock-down, modular furniture frame including a plurality of panels having interlocking sides and at least one tensioning device having a band that girds the plurality of panels to secure the plurality of panels together under tension into an interlocking relationship.

19 Claims, 11 Drawing Sheets

(56) References Cited

U.S. PATENT DOCUMENTS

| | | | | |
|---|---|---|---|---|
| 8,517,189 | B2 | 8/2013 | Donohoe | |
| 2005/0006943 | A1 * | 1/2005 | Wieland | 297/440.13 |
| 2006/0220435 | A1 * | 10/2006 | Carter et al. | 297/440.14 |
| 2008/0191538 | A1 | 8/2008 | Berg et al. | |
| 2010/0025520 | A1 | 2/2010 | Hahm et al. | |
| 2012/0056463 | A1 | 3/2012 | Berent et al. | |
| 2013/0005643 | A1 | 1/2013 | Kim et al. | |
| 2013/0032559 | A1 | 2/2013 | Gregory et al. | |

OTHER PUBLICATIONS

Lovesac—Frequently Asked Questions (2010) at http://www.lovesac.com/faq.html (last visited May 6, 2011), 6 pages.

* cited by examiner

MODULAR KNOCK-DOWN UPHOLSTERED FURNITURE

FIELD OF THE INVENTION

The present invention relates generally to upholstered furniture, and more specifically to modular upholstered furniture.

BACKGROUND OF THE INVENTION

Society, as a whole, is more mobile today than in previous years. The relocation of individuals and families has become a popular practice, which in turn, has encouraged a change in their home furnishings. Conventional home furnishings have been cumbersome to move, expensive to repair, and are often unable to adapt to the layout of a new residence. For at least these reasons, furniture has evolved to facilitate a mobile society.

For example, knock-down furniture was developed to be easily assembled and disassembled for moving and/or shipping the furniture to a new residence. Also, because knock-down furniture disassembles to occupy a smaller area than in its assembled state, knock-down furniture can be stored with relative ease.

Modular furniture has also been developed to accommodate the mobile family. Modular furniture includes one or more components that may be arranged in a number of layouts.

However, the convenience of knock-down furniture and modular furniture has often required the sacrifice of quality, stability, variety of aesthetic designs, and comfort. For example, assembly of knock-down furniture often requires special tools and knowledge of furniture construction. Thus, there remains the need for upholstered furniture that has the benefits of knock-down and modular furniture that does not sacrifice quality, comfort, or appearance.

SUMMARY OF THE INVENTION

The present invention overcomes the foregoing and other shortcomings and drawbacks of known knock-down and modular upholstered furniture by utilizing a frame that is formed by a plurality of panels that are secured to one another under tension and in an interlocking relationship by a tensioning device having a band that girds the plurality of panels.

While the invention will be described in connection with certain embodiments, it will be understood that the invention is not limited to these embodiments. On the contrary, the invention includes all alternatives, modifications, and equivalents as may be included within the spirit and scope of the present invention.

BRIEF DESCRIPTION OF THE FIGURES

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
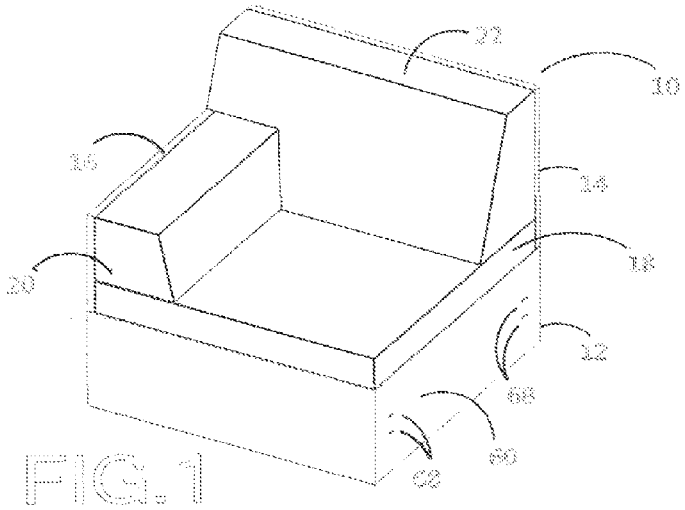
FIG. 1 is a perspective view of an assembled first modular unit.

With reference now to the figures, and particularly to FIG. 1, one embodiment of a first modular unit is described for use as modular, knock-down upholstered furniture. The first modular unit is particularly illustrated as a right end module 10 having a base 12, a back 14, and an arm 16 that is positioned on the right side when the first modular unit 10 is in use. The right end module 10 further includes a seat cushion 18, an arm cushion 20, and a back cushion 22 that are positioned onto an assembled right end module 10. It will readily be appreciated that while the illustrative embodiment is directed to a right end module 10, the embodiments described herein may be readily applied to a left arm module 24 (FIG. 10), a mid-module 26 (FIG. 15B), an ottoman 28 (FIG. 15D), or other as would be known to those of ordinary skill in the arts of furniture design and construction.

Figure 2:
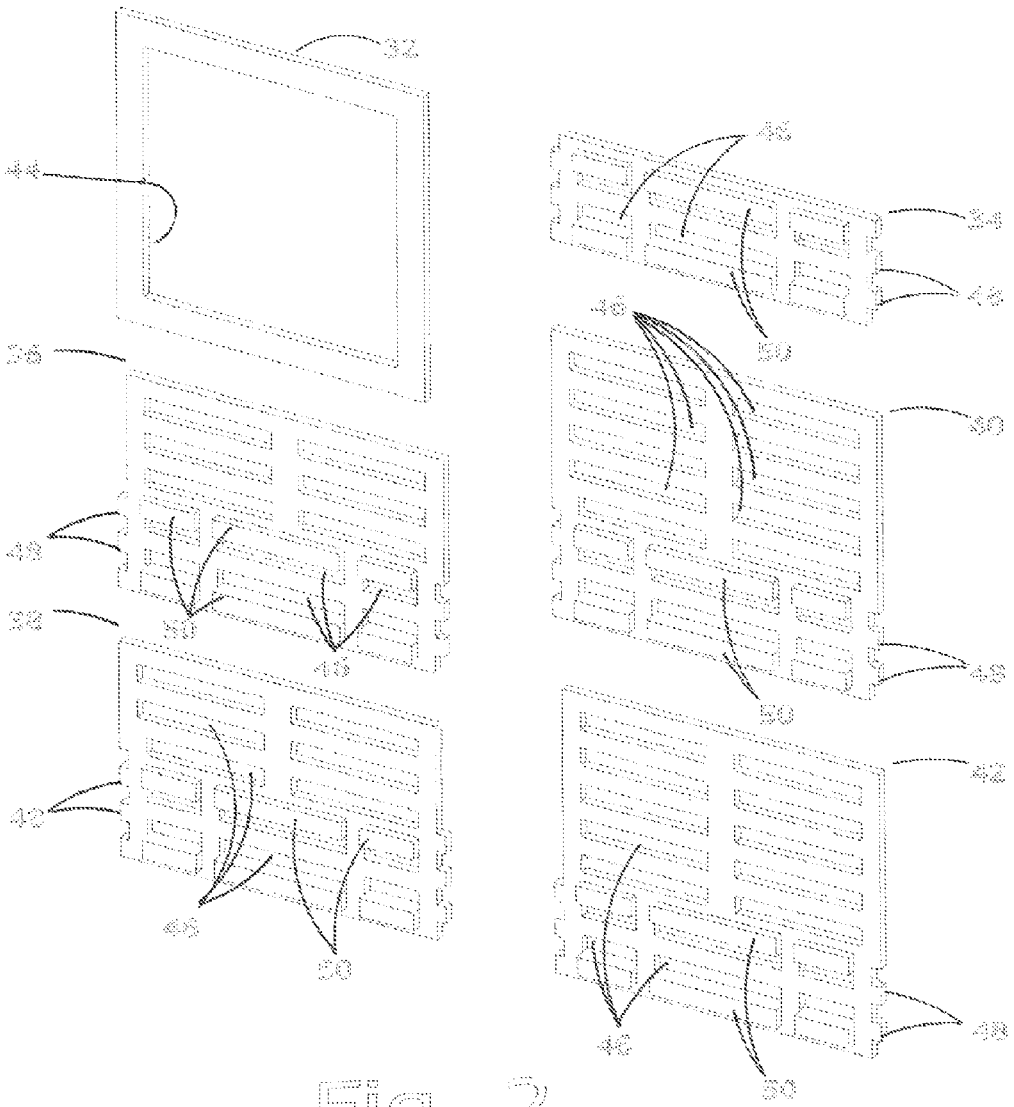
FIG. 2 is a perspective view of a plurality of panels, where select ones of the plurality of panels are used for construction of a frame of the first modular unit of FIG. 1.

FIG. 2 illustrates a plurality of panels, wherein select ones of the plurality of panels are assembled to comprise a frame 30 (FIG. 5) for constructing any of the described modular units. Generally, the plurality of panels includes a cushion support panel 32, a standard panel 34, a left arm panel 36, a right arm panel 38, a back panel 40, and a second back panel 42. Each of the plurality of panels may be constructed by laser cutting a detailed pattern from plywood, medium density fiberboard ("MDF"), or other similar construction material. Alternatively, each of the plurality of panels may be rotationally molded out of a plastic material.

The cushion support panel 32 may be constructed from a solid piece of material or, as shown, a frame-like structure having an open center 44.

Except for the cushion support panel 32, each of the plurality of panels includes a plurality of slots 46 that facilitate assembly as described below and reduces the weight and improves the structural rigidity of each panel. As shown in greater detail in FIG. 3, each of these panels (front and back of the standard panel 34 are shown) includes at least a common lower portion having keyed interlocking tabs 48 on the sides of the common lower portion. The tabs 48 are keyed such that the tabs (illustrated as 48*a*) on a first side of a given panel align to the tabs (illustrated as 48*b*) of a second side of an adjacent panel. In this way, the panels may only be assembled in the appropriate manner.

Figure 3:
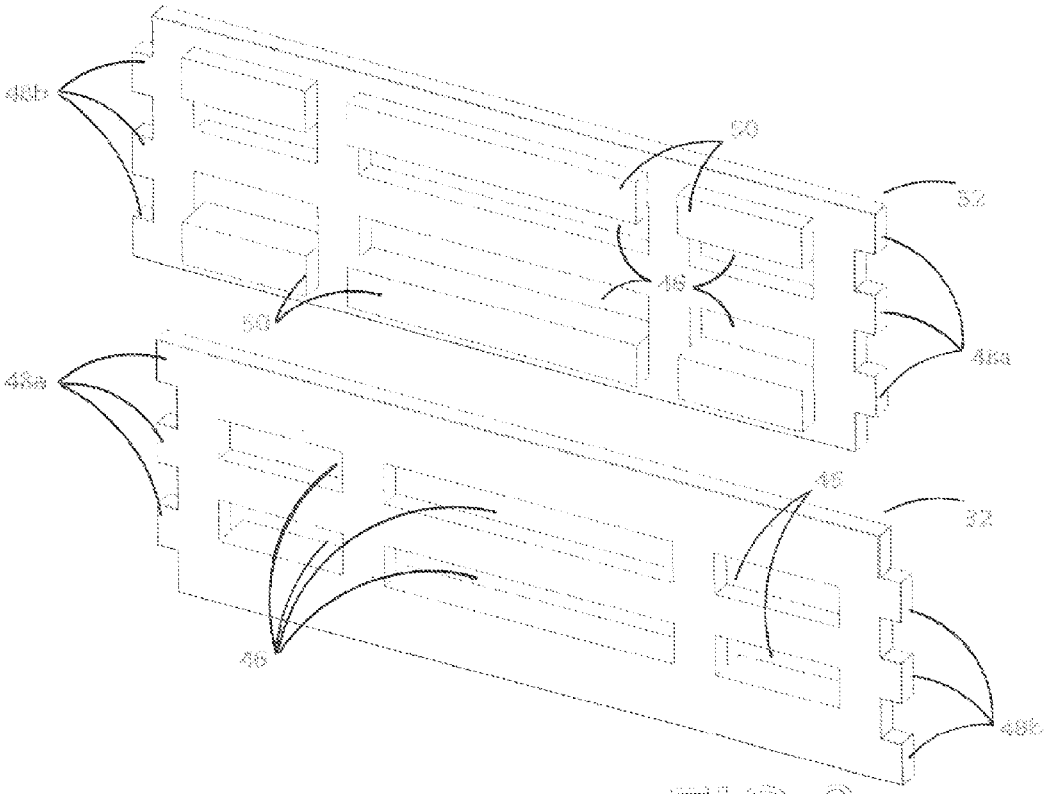
FIG. 3 is an enlarged perspective view of the front and back of the standard panel of FIG. 2.

Referring still to FIG. 3, the common lower portions of each of the plurality of panels may also include at least one inner cushion panel support bracket 50 (two sets of support brackets 50 are shown). The support brackets 50 are illustrated in the exemplary embodiment as series of blocks protruding inwardly from each slot 46. The series of blocks provide adequate support to the cushion support panel 32 (FIG. 2) without adding excessive weight to the constructed frame 30 (FIG. 5).

Figure 4:
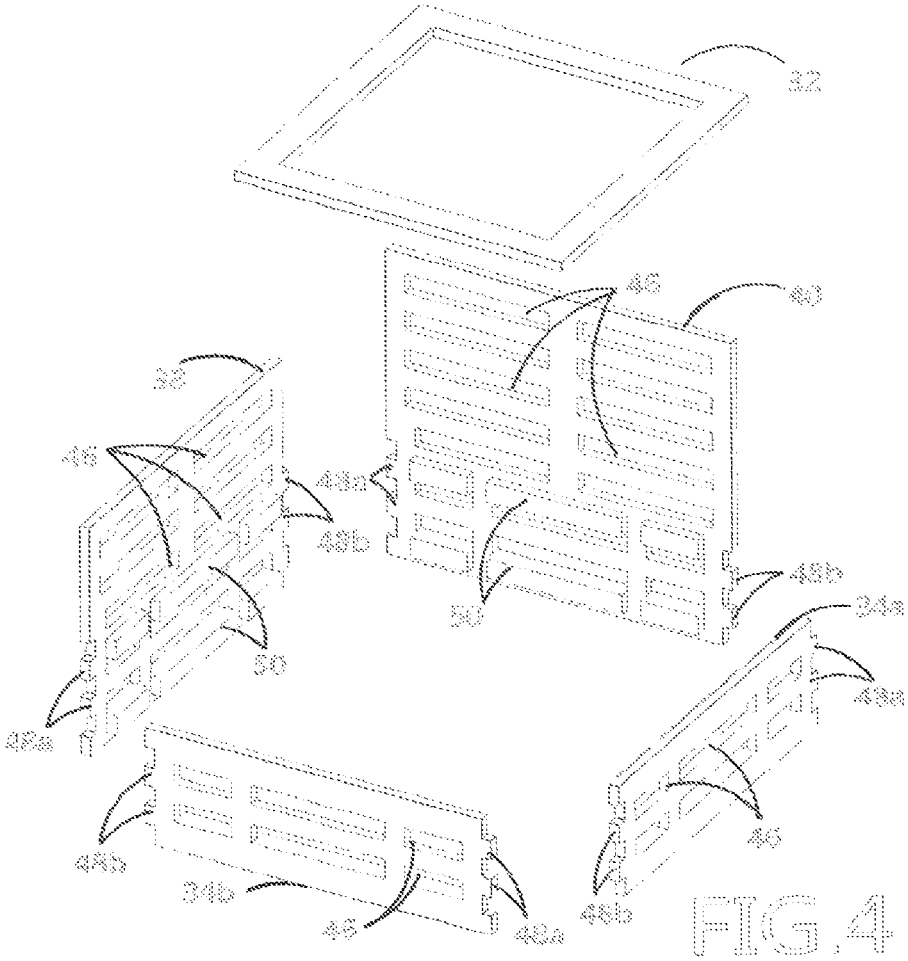
FIG. 4 is a perspective view of the plurality of panels of FIG. 2 arranged for assembly.

With reference now to FIG. 4, the select ones of the plurality of panels for assembling the right end module 10 are illustrated in an arrangement ready for assembly. Specifically, the select ones include one cushion support panel 32, one back panel 40, one right arm panel 38, and two standard panels (left panel 34*a* and front panel 34*b*). The tabs 48 of the common lower portions of the back panel 18, the right arm panel 16, and the two standard panels 12 are aligned and coupled together to form the frame 30 as shown in FIG. 5.

Figure 5:
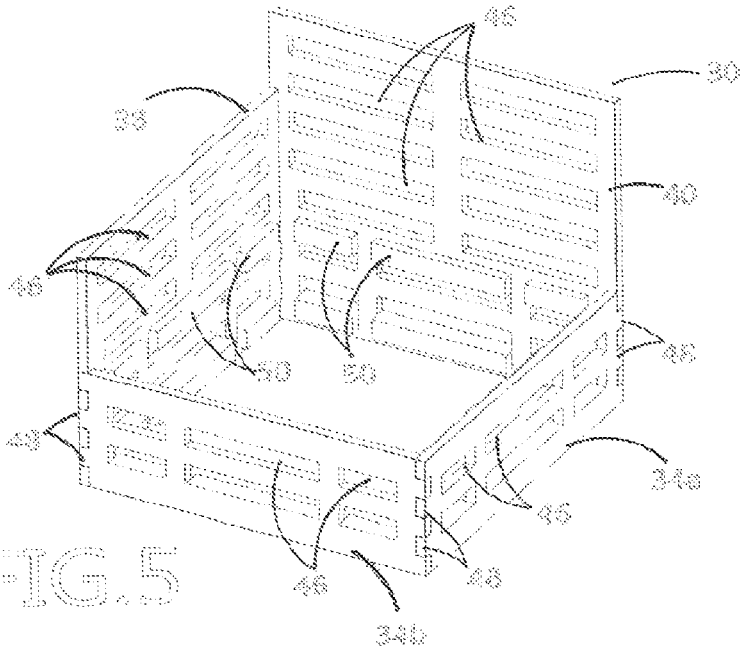
FIG. 5 is a perspective view of the plurality of panels of FIG. 4 assembled in interlocking relationship.
Figure 6:
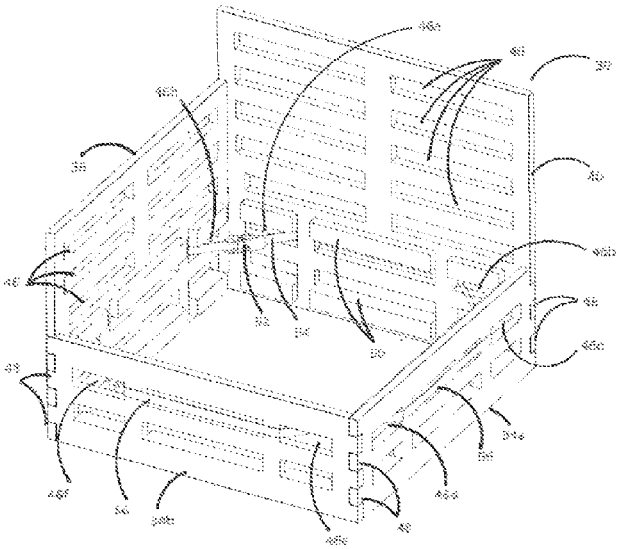
FIG. 6 is an assembled perspective view of the frame of FIG. 3 secured by one or more bands.

FIG. 6 illustrates one method of securing the panels as arranged and assembled in FIG. 5 with at least one tensioning device. Tensioning devices may include, for example, one or more hand winch come-a-longs or turnbuckles, though a single come-a-long 52 with a ratchet 54 and a band 56 is shown. The ratchet 54 is desirably positioned within the volume defined by the frame 30 at a corner formed by the juncture of two panels (shown between the right arm panel 38 and the back panel 40), and at least a portion of the band 56 extends within the interior space, or volume, formed by the panels that define the frame 30. This position ensures that the ratchet 54 is concealed when upholstery is applied to the frame 30.

The band 56 of the come-a-long 52 is woven through the panels, e.g., the band 56 will traverse the slot 46*a* of the back panel 40 at the interior corner of the junction between the back panel 40 and the right arm panel 38, run along the outside surface of the back panel 40, and traverse the slot 46*b* of the back panel 40 at the interior corner of the junction between the back panel 40 and the left panel 34*a*. The band 56 will then traverse the slot 46*c* of the left panel 34*a* at the interior corner of the junction between the back panel 40 and the left panel 34*a*, run along the outside surface of the left panel 34*a*, and traverse the slot 46*d* of the left panel 34*a* at the interior corner of the junction between the left panel 34*a* and the front panel 34*b*. The weaving continues, in like manner, with respect to the front panel 34*b* and the right arm panel 38 until the band 56 meets the ratchet 54 and is secured in a conventional manner. Once the frame 30 is assembled and secured, it is ready to receive upholstery.

In some embodiments, it may be beneficial to not fully tension the band 56 within the ratchet 54, allowing some movement within the frame 30, so that the upholstery may be positioned fully over the frame.

It will be appreciated that other types of tensioning devices may be used in other embodiments of the invention. For example, various types of bands may be used, including belts, straps, ropes, chains, cords, cables, and bands that are formed of any number of elastic or inelastic materials, i.e., synthetic fibers such as nylon or polypropylene, natural fibers such as hemp or cotton, or various metals. In addition, various types of securing mechanisms, e.g., ratchets, winches, etc., may be used to apply tension to the band. The securing mechanisms are desirably, but not necessarily, capable of being released to enable easy disassembly and reassembly of the frame. Moreover, while the illustrated embodiments apply tension via a ratchet that engages both ends of the band, in other embodiments, one or both ends of the band may be secured, for example, to the panels themselves, e.g., via hooks, with a ratchet, or other securing mechanism used to apply tension to the band. In yet other embodiments, a band may be formed from multiple belts or straps that are joined together in a tensioned relationship by a ratchet or other securing mechanism.

It will be appreciated that band 56 girds and encircles the panels that form the frame 30 in much the same way as a belt, and thus draws the panels together under tension into an interlocking relationship. It will also be appreciated that in girding the panels, some portions of the band may extend along outer surface of the panels, while other portions extend along inner surfaces of the panels and/or within the interior space formed by and between the panels. In other embodiments, the band may extend exclusively around the outer surfaces of the panels, while in still other embodiments, the band may extend exclusively along the inner surface of the panels and/or within the interior space between the panels. As an example of the latter case, the panels may include eyelets on interior surface thereof through which the band is threaded.

It will be appreciated that a wide variety of alternate tensioning devices may be used to gird the panels together under tension and into an interlocking relationship. Therefore, the invention is not limited to the particular embodiments disclosed herein.

Figure 7:
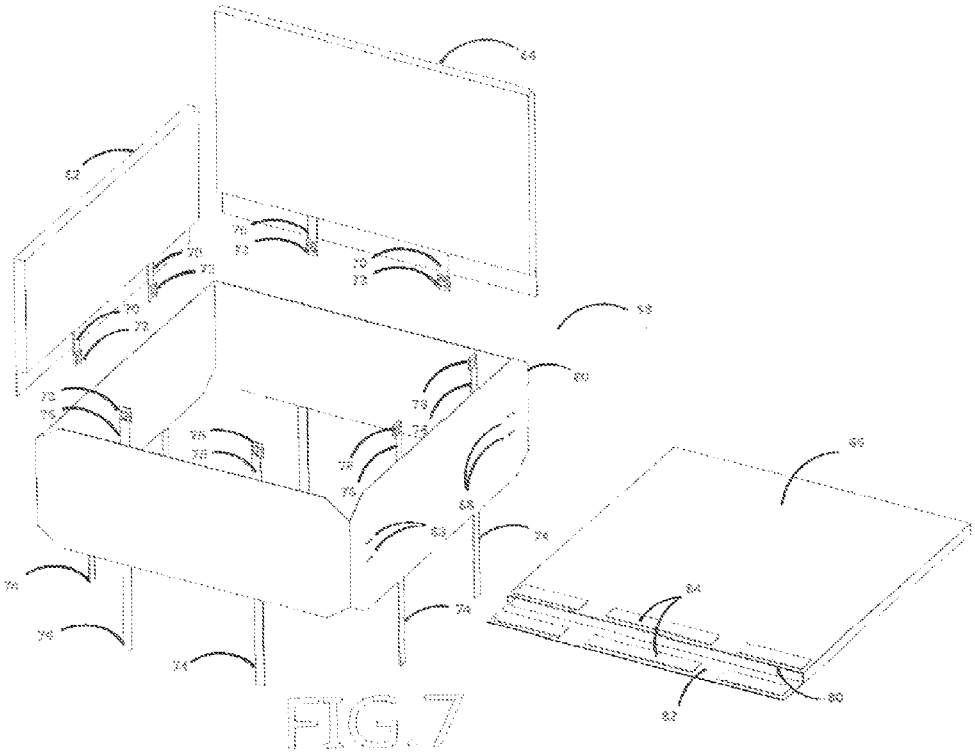
FIG. 7 is a perspective view of an upholstery unit.

With reference now to FIG. 7, one embodiment of an upholstery unit 58 for use with the assembled and secured frame 30 of FIG. 6 is shown with greater detail. The upholstery unit 58 includes a skirt 60, an armrest sleeve 62, a backrest sleeve 64, and a cushion support panel sleeve 66. Each of the skirt 60, the armrest sleeve 62, and backrest sleeve 64 may be constructed from consumer grade upholstery fabric, leather, or other upholstery material as desired to slip over and conform to the shape of the respective panel.

The skirt 60 may include one or more pairs of eyelets for coupling the upholstered modules together, as described in greater detail below.

The armrest and backrest sleeves 62, 64 include two or more leads 70, each having a length adjuster 72 coupled to the ends opposing the sleeve. The leads 70 extend downwardly from an inner facing lower edge of the respective sleeve 62, 64. The skirt 60 includes a plurality of securing leads 74 extending downwardly therefrom and a plurality of leads 76 having length adjusters 78 extending upwardly therefrom. Use of the leads 70, 74, 76 for upholstering the frame 30 (FIG. 5) is described in greater detail below.

The cushion support panel sleeve 66 may be constructed from industrial strength fabric, for example 1080 denier ballistic grade nylon, that upholsters the cushion support panel 32 (FIG. 4) but also provides a soft suspension for the seat cushion 18 (FIG. 1) that is positioned atop the upholstered cushion support panel 32 (FIG. 4). The cushion support panel sleeve 66 may be constructed with an open end 80 so as to receive the cushion support panel 32 (FIG. 4). The open end 80 may further include a flap 82 having securement pads 84 (e.g., VELCRO) to close and secure the flap 82 at corresponding securement pads 84 on the cushion support panel sleeve 66 positioned at the open end 80.

The use of separate sleeves comprising the upholstery unit 58, as described above, provides the benefit of providing a sharper design as each sleeve is separately secured over the frame 30 (FIG. 5). Also, the individual sleeves may be separately cleaned or replaced as necessary and provide the unique situation where multiple color or design sleeves may be used to customize the furniture according to personal taste.

Figure 8:
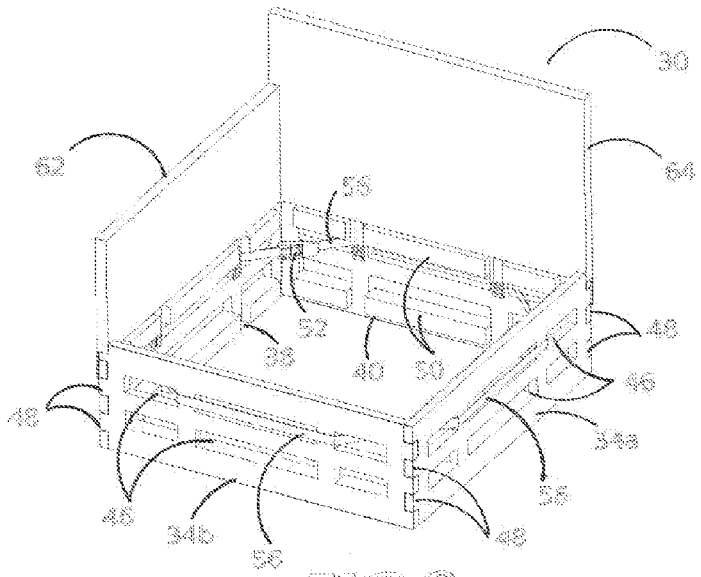
FIGS. 8-9B are perspective views of the first modular unit, illustrating successive steps of an exemplary method of applying the upholstery unit of FIG. 7 to the assembled first modular unit of FIG. 6.
Figure 9A:
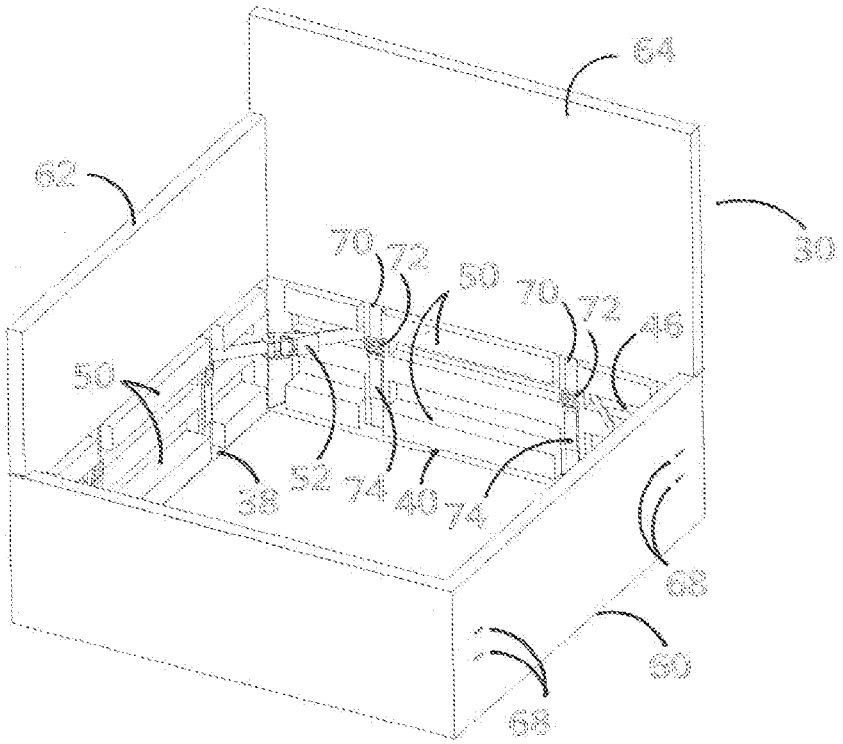
Figure 9B:
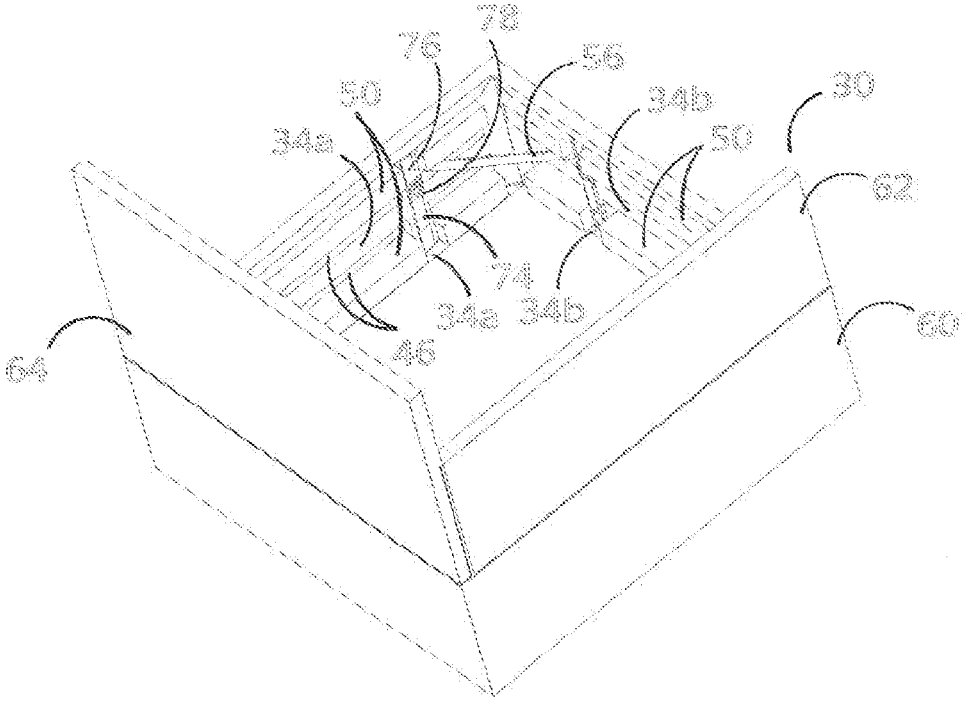

Turning now to FIGS. 8-9B, one exemplary method of applying the upholstery unit 58 to the assembled frame 30 (FIG. 5) is shown with greater detail. As shown, each sleeve is slipped over the respective panel, such as: the armrest sleeve 68 is slipped vertically down from the top of the right armrest panel 38 (FIG. 5) to encase at least an upper portion of the right armrest panel 38 (FIG. 5), and the backrest sleeve 64 is slipped vertically down from the top of the back panel 40 (FIG. 5) to encase at least an upper portion of the back panel 40 (FIG. 5).

Once the armrest and backrest sleeves 62, 64 are properly positioned, the come-a-long 52, or other tensioning device as used, may be fully tightened if left lax previously.

Turning now to FIGS. 9A and 9B, the skirt is slipped down over the partially upholstered frame 30 so as to encase the outside lower portions of the frame 30. The various leads 70, 74, 76 are joined and secured within the volume defined by the lower portions of the frame 30. Specifically, the leads 70 with length adjusters 72 of the armrest and backrest sleeves 62, 64 extend through appropriate slots 46 and are aligned and coupled to the corresponding leads 74 of the skirt 60 also extending through appropriate slots 46. The remaining leads 74 of the skirt 60 extend through appropriate slots 46 and are coupled with the leads 76 with length adjusters 78, also on the skirt 60. Once secured, the skirt 60 may encase any portion of fabric extending from the backrest and armrest sleeves 64, 62.

Figure 10:
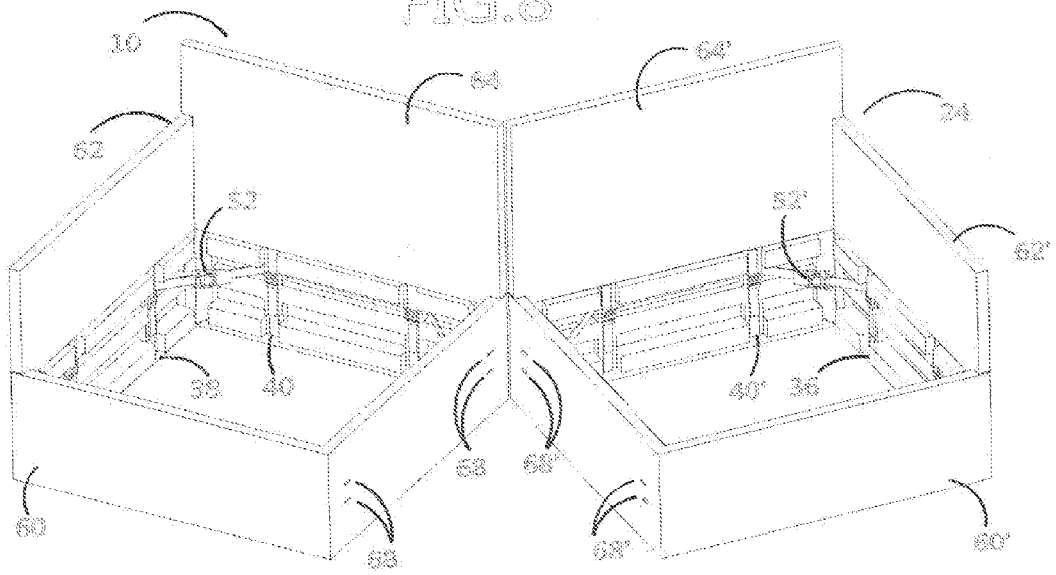
FIGS. 10-11 B are perspective views of the assembled and upholstered first modular unit combined with an assembled and upholstered second modular unit.
Figure 11A:
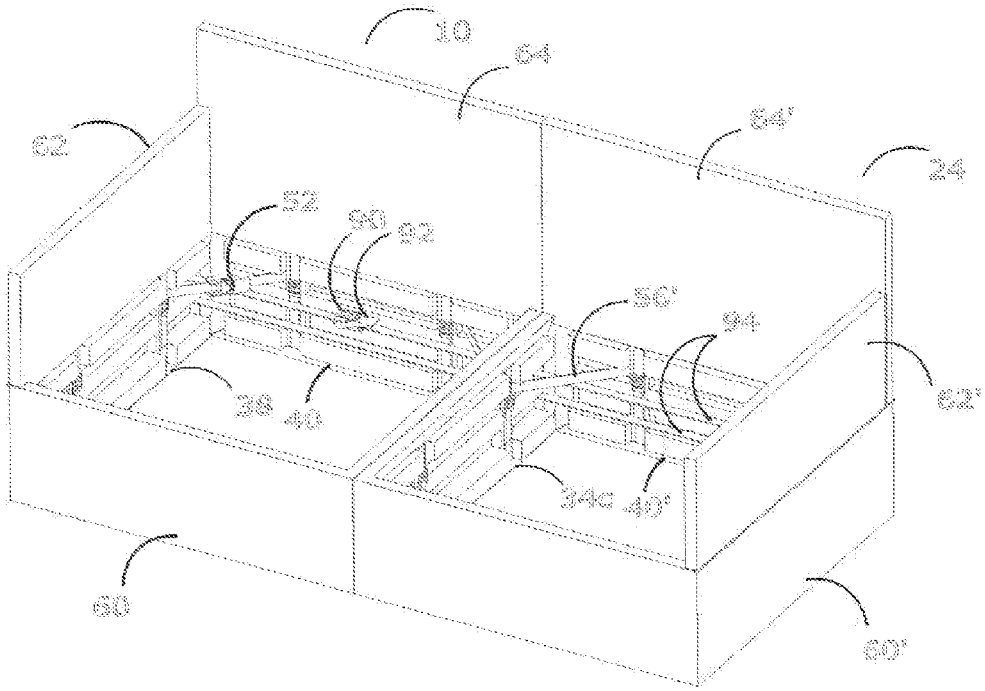
Figure 11B:
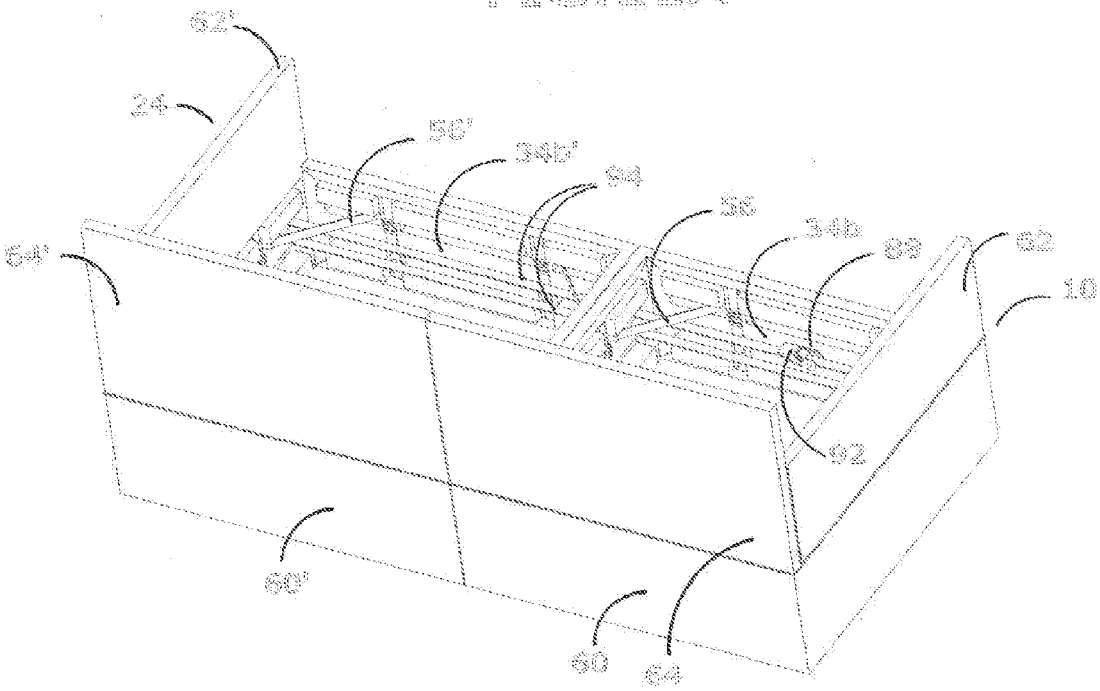
Figure 15A:
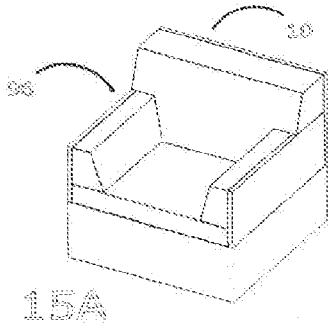
FIGS. 15A-15E are perspective views of various layouts of the first modular unit alone and with one or more additional modular units.
Figure 15B:
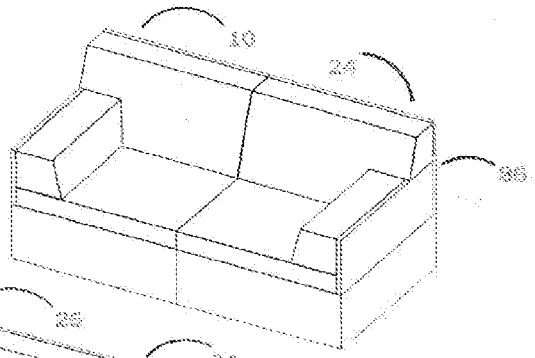
Figure 15C:
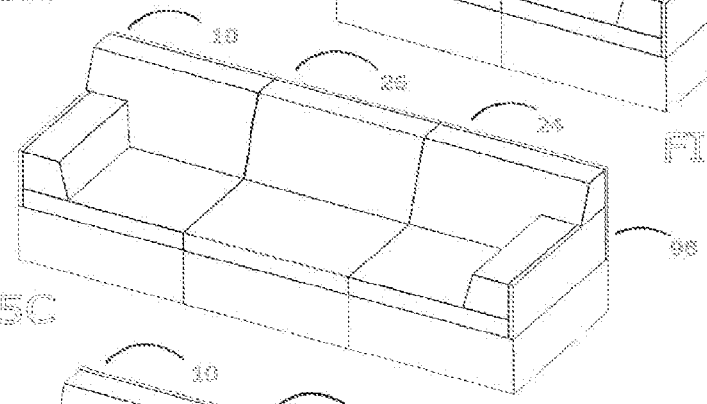

In FIGS. 10-11 B, the right end module 10 and the left end module 24, constructed in a similar manner, are positioned side-by-side to be coupled together to form what has conventionally been called a love seat 86 (FIG. 15B). Coupling of the modules 10, 24 together may include two tensioning devices 88, 90, such as those that were described in detail previously. Accordingly, the ratchets 92 of the two tensioning devices 88, 90 are positioned within the volume of one module (illustrated as the right arm module 10) and the corresponding belts 94 are woven through adjacent eyelets 68, 68' of both skirts 60, 60' into the other module (the left arm module 24), through another pair of eyelets 68, 68' of the skirt 60, through a pair of slots 48 (FIG. 2) in the right arm panel 38 (FIG. 2) and then secured at the ratchet 92.

Figure 12:
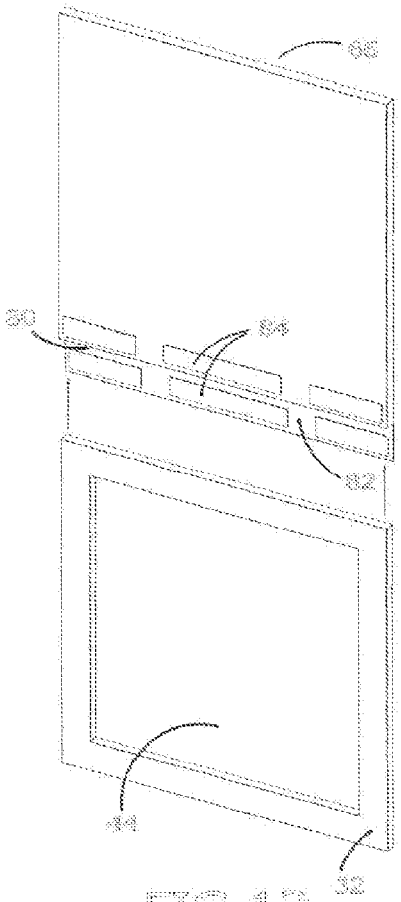
FIG. 12 is perspective view of a cushion support panel and a cushion sleeve.

In FIG. 12, the cushion support panel 32 is inserted into the cushion support panel sleeve 66 and secured by the securement pads 84. The upholstered cushion support panel 32 is then placed onto the support brackets 50 of the frame 30 such that the front edge of the upholstered cushion support panel 32 aligns flush with the front edge of the front panel 34*b*. In this way, the volume surrounded by the frame 30 may be accessed for additional storage and/or to adjust one or more of the tensioning devices. In some embodiments, the cushion support panel 32 may be more permanently or hingedly secured to the frame 30 and would limit this access.

Figure 14:
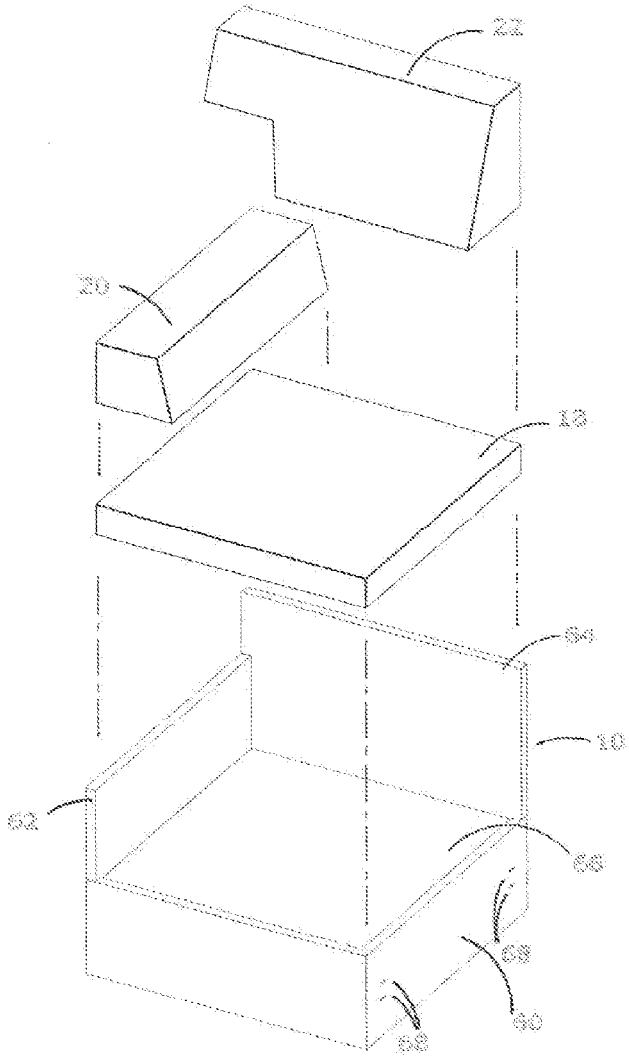
FIG. 14 is a disassembled perspective view of the assembled and upholstered first modular unit with a seat cushion, an arm cushion, and a back cushion.
Figure 13:
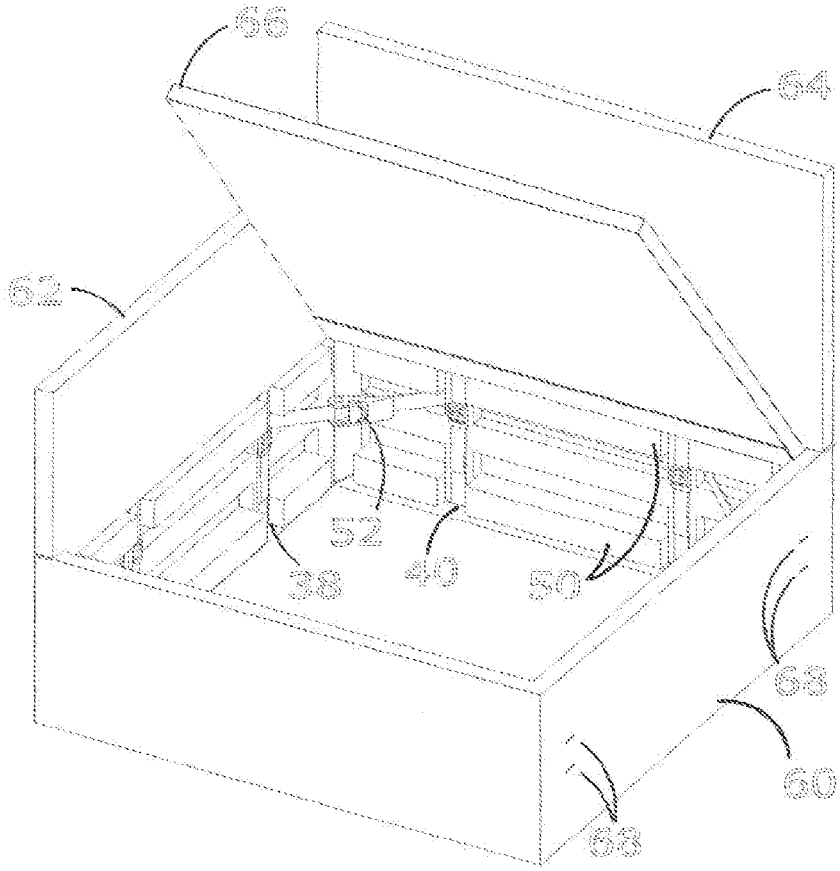
FIG. 13 is a perspective view of the assembled and upholstered first modular unit of FIG. 9A with an assembled cushion support panel and sleeve.

With the upholstery steps complete, the one or more seat cushions 18, 20, 22 may be positioned onto the module 10. For example, as shown in FIG. 14, the seat cushion 18 is positioned onto the upholstered cushion support panel 32, followed by the arm cushion 20 and the back cushion 22, as applicable.

FIGS. 15A-15E illustrates various upholstered furniture configurations that may be constructed with panels as shown in Table 1.

TABLE 1

Figure 15D:
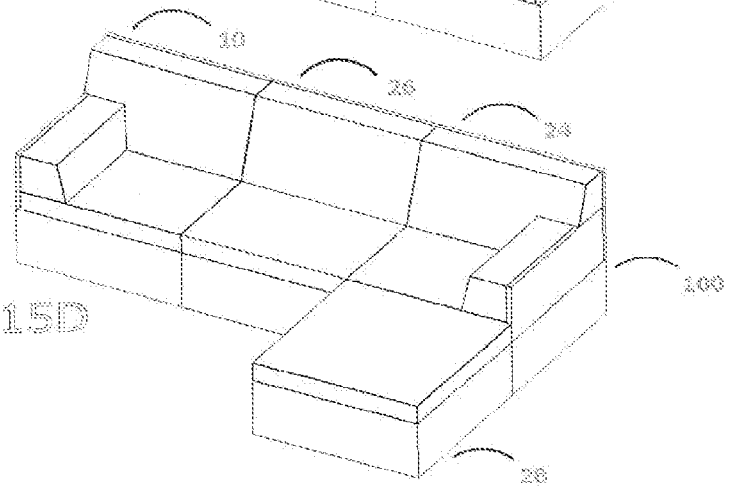
Figure 15E:
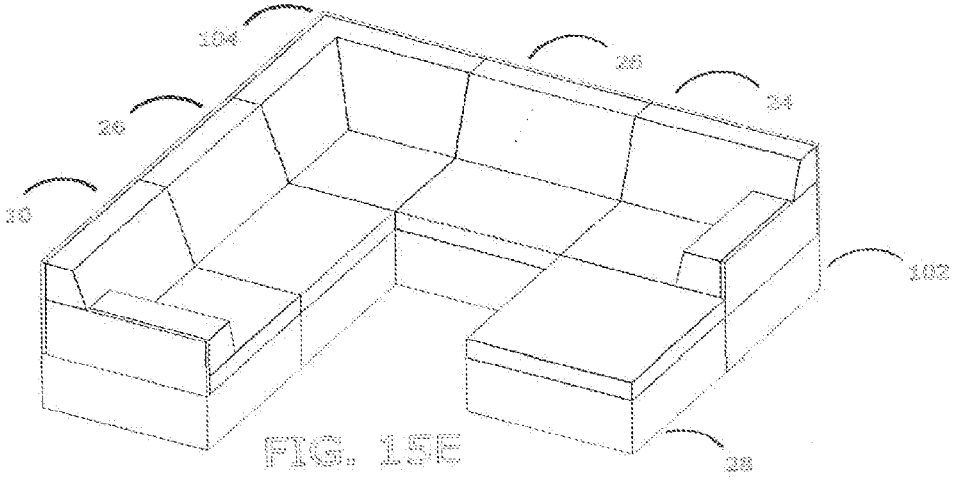

| | Cushion support 32 | Standard 34 | Left arm 36 | Right arm 38 | Back 40 | Second Back 42 |
|---|---|---|---|---|---|---|
| Armchair 96 (FIG. 15A) | 1 | 1 | 1 | 1 | 1 | 0 |
| Loveseat 86 (FIG. 15B) | 2 | 4 | 1 | 1 | 2 | 0 |
| Sofa 98 (FIG. 15C) | 3 | 7 | 1 | 1 | 3 | 0 |
| Sofa & ottoman 100 (FIG. 15D | 4 | 11 | 1 | 1 | 3 | 0 |
| Sectional & ottoman 102 (FIG. 15E) | 6 | 16 | 1 | 1 | 5 | 1 |

The second back panel 42 may be constructed in a manner that is similar to the back panel 40 but with the upright portion extending from the common lower portion of the second back panel 42 is configured to abut, or otherwise adjoin, the back panel 40 when forming a corner 104 of the sectional 102. This may include, for example, reducing the span of the upright portion of the second back panel 42 as compared to the back panel 40.

Figure 17:
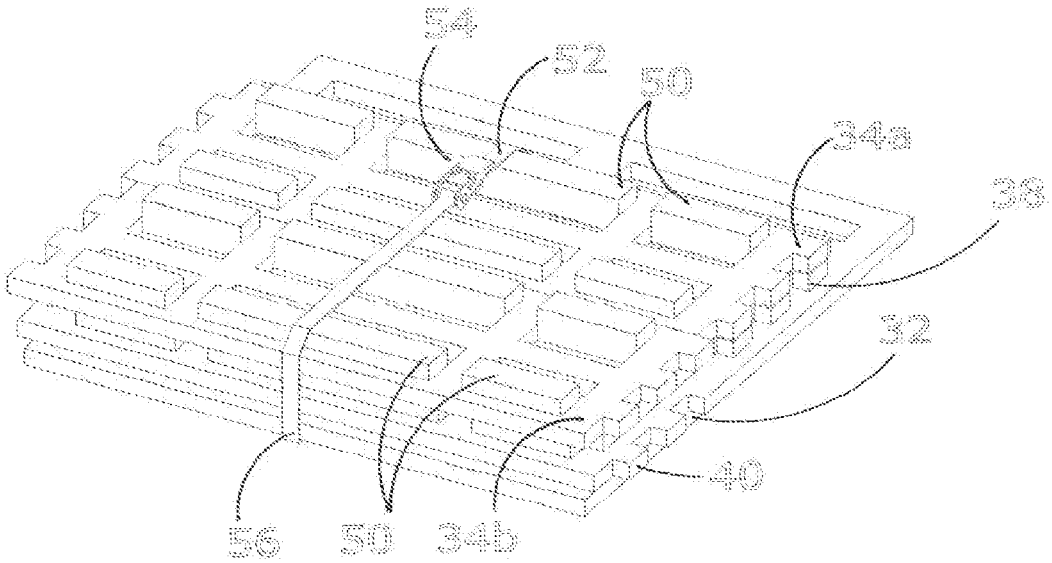
FIG. 17 is an assembled perspective view of the frame of FIG. 16.
Figure 16:
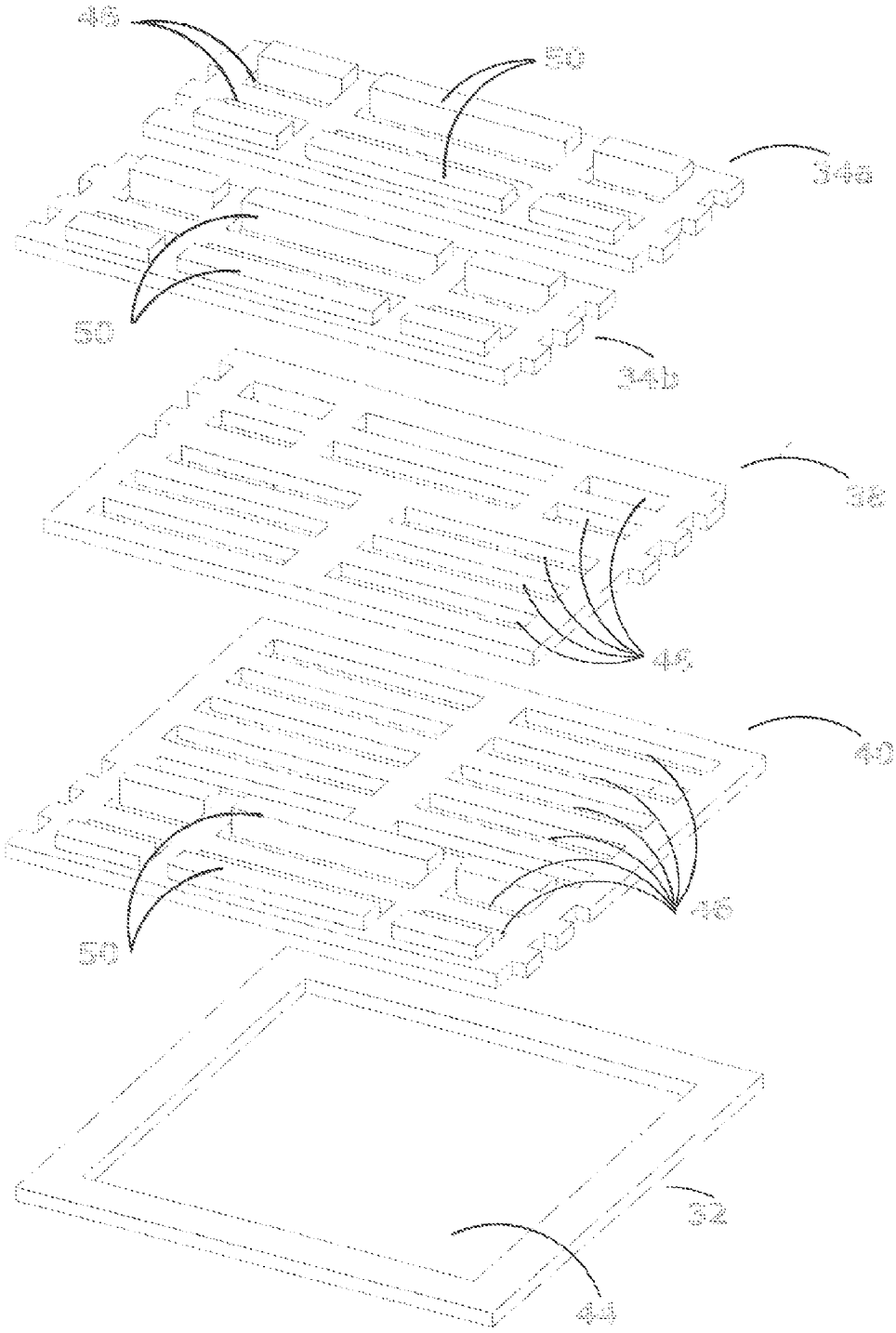
FIG. 16 is a disassembled perspective view of the frame of FIG. 2 arranged for storage.

FIGS. 16 and 17 illustrate one method of stacking the panels for transporting and/or storing the panels. As shown, the panels 32, 34*a*, 34*b*, 38, 40 may be stacked in an efficient manner and then secured together with one or more of the come-a-long 52 used in assembly.

While the present invention has been illustrated by a description of various embodiments, and while these embodiments have been described in some detail, they are not intended to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with methods of practicing the present invention as currently known. However, the invention itself should only be defined by the appended claims.

What is claimed is:

1. A modular furniture frame comprising:

a plurality of panels, each of the plurality of panels having interlocking sides; and at least one tensioning device having a band that girds and encircles the plurality of panels to secure the plurality of panels together under tension into an interlocking relationship wherein at least a portion of the band extends through an interior space defined by the plurality of panels.

2. The modular furniture frame of claim 1, wherein each of the plurality of panels further includes at least one cushion panel support bracket.

3. The modular furniture frame of claim 2 further comprising:

a cushion support panel placed onto the cushion panel support bracket when the frame is assembled, the cushion support panel configured to support a seat cushion.

4. The modular furniture frame of claim 1, wherein the tensioning device includes a ratchet for tensioning the band.

5. The modular furniture frame of claim 1, wherein the interlocking sides include keyed tabs.

6. The modular furniture frame of claim 1, wherein each of the plurality of panels is constructed from plywood, MDF, or molded plastic.

7. The modular furniture frame of claim 1, wherein each of the plurality of panels includes a plurality of slots, wherein the band extends through the plurality of slots in the plurality of panels.

8. A modular knock-down upholstered furniture module comprising:

a plurality of panels configured to assemble a frame, each panel having interlocking sides;

at least one tensioning device having a band that girds and encircles the plurality of panels to secure the plurality of panels together under tension into an interlocking relationship wherein at least a portion of the band extends through an interior space defined by the plurality of panels; and an upholstery sleeve configured to be slipped onto at least one of the plurality of panels.

9. The knock-down upholstered furniture module of claim 8, wherein each of the plurality of panels further includes at least one cushion panel support bracket.

10. The knock-down upholstered furniture module of claim 9 further comprising:

a cushion support panel placed onto the cushion panel support bracket when the frame is assembled, the cushion support panel configured to support a seat cushion.

11. A modular knock-down upholstered furniture module comprising:

a plurality of panels configured to assemble a frame, each panel having interlocking sides;

at least one tensioning device having a band that girds the plurality of panels to secure the plurality of panels together under tension into an interlocking relationship; and an upholstery sleeve configured to be slipped onto at least one of the plurality of panels, wherein the upholstery sleeve includes at least one pair of eyelets for passing another tensioning device between assembled modules.

12. The knock-down upholstered furniture module of claim 8, wherein each of the plurality of panels includes a plurality of slots, wherein the band extends through the plurality of slots in the plurality of panels.

13. The modular furniture frame of claim 1, further comprising another tensioning device configured to secure the modular furniture frame to another modular furniture frame.

14. The modular furniture frame of claim 1, wherein the plurality of panels includes first, second, third and fourth panels, wherein the at least one tensioning device girds the first, second, third and fourth panels to secure the first, second, third and fourth panels together under tension into an interlocking relationship with an interior space defined therebetween.

15. The modular furniture frame of claim 14, wherein at least a portion of the at least one tensioning device extends along an outer surface of each of the first, second, third and fourth panels.

16. The modular furniture frame of claim 14, wherein at least a portion of the at least one tensioning device extends along an inner surface of each of the first, second, third and fourth panels.

17. The modular furniture frame of claim 14, wherein the first, second, third and fourth panels are arranged in a generally rectangular relationship, and wherein the at least one tensioning device girds the first, second, third and fourth panels to secure the first, second, third and fourth panels together in the generally rectangular relationship.

18. The knock-down upholstered furniture module of claim 8, further comprising another tensioning device configured to secure the knock-down upholstered furniture module to another knock-down upholstered furniture module.

19. The knock-down upholstered furniture module of claim 8, wherein the plurality of panels includes first, second, third and fourth panels, wherein the at least one tensioning device girds the first, second, third and fourth panels to secure the first, second, third and fourth panels together under tension into an interlocking relationship with an interior space defined therebetween.

* * * * *